US010224048B2

(12) United States Patent
Kamano et al.

(10) Patent No.: US 10,224,048 B2
(45) Date of Patent: Mar. 5, 2019

(54) AUDIO CODING DEVICE AND AUDIO CODING METHOD

(71) Applicant: FUJITSU LIMITED, Kawasaki-shi, Kanagawa (JP)

(72) Inventors: Akira Kamano, Kawasaki (JP); Yohei Kishi, Kawasaki (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/809,623

(22) Filed: Nov. 10, 2017

(65) Prior Publication Data

US 2018/0182403 A1 Jun. 28, 2018

(30) Foreign Application Priority Data

Dec. 27, 2016 (JP) ..... 2016-254286

(51) Int. Cl.
*G10L 19/02* (2013.01)
*G10L 19/24* (2013.01)
(Continued)

(52) U.S. Cl.
CPC ..... *G10L 19/0208* (2013.01); *G10L 19/24* (2013.01); *G10L 19/26* (2013.01);
(Continued)

(58) Field of Classification Search
CPC ..... G10L 19/0208; G10L 25/18; G10L 19/26; G10L 19/24; G10L 21/038; G10L 21/0216; G10L 19/0204
See application file for complete search history.

(56) References Cited

U.S. PATENT DOCUMENTS 7,069,212 B2 * 6/2006 Tanaka ..... G10L 21/038 704/225
7,469,206 B2 * 12/2008 Kjorling ..... G10L 19/07 704/205
(Continued)

FOREIGN PATENT DOCUMENTS

JP 2008-96567 4/2008

OTHER PUBLICATIONS

Technical Specification, "Digital cellular telecommunications system (Phase 2+); Universal Mobile Telecommunications System (UMTS); LTE; General audio codec audio processing functions; Enhanced aacPlus general audio codec; Enhanced aacPlus encoder Spectral Band Replication (SBR) part (3GPP TS 26.404 version 13.0.0 Release 13)", European Telecommunications Standards Institute (ETSI), vol. 3GPP SA 4, No. V13.0.0, pp. 1-35, Jan. 1, 2016, France, XP014266064.
(Continued)

*Primary Examiner* — Brian L Albertalli
(74) *Attorney, Agent, or Firm* — Fujitsu Patent Center

(57) ABSTRACT

An audio coding device includes a filter configured to extract a low-band signal having a first frequency component from an input signal, a memory, and a processor coupled to the memory and configured to extract envelope information relating to an envelope of a high-band signal having a second frequency component which is higher than the first frequency component in the input signal, detect tone information that is information on a tone signal included in a high-band signal spectrum from the input signal, correct the envelope information based on a difference between frequency of the tone signal and frequency of a peak of the envelope, and code the low-band signal, the tone information, and the envelope information that is corrected.

6 Claims, 13 Drawing Sheets

(51) Int. Cl.

| | |
|---|---|
| ***G10L 19/26*** | (2013.01) |
| ***G10L 25/18*** | (2013.01) |
| ***G10L 21/038*** | (2013.01) |
| ***G10L 21/0216*** | (2013.01) |

(52) U.S. Cl.
CPC ..... *G10L 21/038* (2013.01); *G10L 25/18* (2013.01); *G10L 19/0204* (2013.01); *G10L 21/0216* (2013.01)

(56) References Cited

U.S. PATENT DOCUMENTS 8,041,577 B2 * 10/2011 Smaragdis ..... G10L 21/038 704/500
8,244,524 B2 * 8/2012 Shirakawa ..... G10L 19/02 704/205
8,527,283 B2 * 9/2013 Jasiuk ..... G10L 21/038 704/205
8,560,330 B2 * 10/2013 Gao ..... G10L 21/038 704/208
2007/0156397 A1 * 7/2007 Chong ..... G10L 19/032 704/229
2013/0006644 A1 * 1/2013 Jiang ..... G10L 21/038 704/500
2013/0275142 A1 * 10/2013 Hatanaka ..... G10L 19/0204 704/500
2015/0162010 A1 * 6/2015 Ishikawa ..... G10L 21/038 704/500
2016/0111103 A1 * 4/2016 Nagisetty ..... G10L 19/24 704/501

OTHER PUBLICATIONS

3rd Generation Partnership Project(3GPP), "Coding of upper band for LP-based Coding Modes", 3GPP Draft; 26445-D40 4 S050206, 3GPP TS 26.445 V13.4.0, Release 12, Dec. 9, 2016, pp. 219-267, Mobile Competence Centre; 650, Route Des Lucioles; F-06921 Sophia-Antipolis Cedex; France, XP051200565, Retrieved from the Internet:URL: http://www.3gpp.org/ftp/tsg_sa/WG4_CODEC/Specs_update_after_SA74/. [retrieved on Dec. 9, 2016].
Liu, Chi-Min et al.; "Compression Artifacts in Perceptual Audio Coding", IEEE Transactions on Audio, Speech and Language Processing, IEEE, vol. 16, No. 4, May 1, 2008, pp. 681-695, XP011207621.
Nagel, Frederik et al., "A Harmonic Bandwidth Extension Method for Audio Codecs", Acoustics, Speech and Signal Processing, ICASSP, IEEE International Conference on, IEEE, Apr. 19, 2009, pp. 145-148, XP031459187.
Extended European Search Report dated Feb. 9, 2018 for corresponding European Patent Application No. 17201820.2, 6 pages.

* cited by examiner

AUDIO CODING DEVICE AND AUDIO CODING METHOD

CROSS-REFERENCE TO RELATED APPLICATION

This application is based upon and claims the benefit of priority of the prior Japanese Patent Application No. 2016-254286, filed on Dec. 27, 2016, the entire contents of which are incorporated herein by reference.

FIELD

The embodiment discussed herein is related to an audio coding device and an audio coding method.

BACKGROUND

As one of audio coding techniques to compress and expand an audio signal of voice, music, or the like, there is a spectral band replication (SBR) technique. The SBR technique is a technique in which an audio signal is compressed by reproducing a high-band component from a low-band component. The SBR technique is a technique that enables coding with high sound quality at a low rate and therefore is used for various use purposes.

In audio coding, the SBR technique extracts a low-band component from an input sound source and extracts envelope information and tone information from a high-band component for information amount compression. The SBR technique replicates the low-band component to reproduce the high-band component. The envelope information is used for correcting the magnitude of energy of the high-band component reproduced through the replication. On the other hand, it is difficult to reproduce a signal that exists only in the high-band component through the replication of the low-band component. Thus, the SBR technique acquires information relating to the frequency and the magnitude of the energy about a tone signal that exists only in the high-band component as the tone information. The tone signal is a signal with a single frequency that is artificially given. The tone signal that exists only in the high band is included in music or the like performed by an electronic musical instrument. At the time of decoding, the tone signal is added based on the tone information to the high-band component reproduced with the envelope information and thereby the high-band component may be accurately decoded. For example, a technique using the SBR is disclosed in Japanese Laid-open Patent Publication No. 2008-96567.

CITATION LIST

Patent Document

[Patent Document 1] Japanese Laid-open Patent Publication No. 2008-96567

SUMMARY

According to an aspect of the embodiment, an audio coding device includes a filter configured to extract a low-band signal having a first frequency component from an input signal, a memory, and a processor coupled to the memory and configured to extract envelope information relating to an envelope of a high-band signal having a second frequency component which is higher than the first frequency component in the input signal, detect tone information that is information on a tone signal included in a high-band signal spectrum from the input signal, correct the envelope information based on a difference between frequency of the tone signal and frequency of a peak of the envelope, and code the low-band signal, the tone information, and the envelope information that is corrected.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

In the technique of Japanese Laid-open Patent Publication No. 2008-96567, there is the case in which a peak on an envelope reproduced based on the envelope information and the peak of a tone signal given based on the tone information exist with a very small frequency difference. In the case in which such peaks exist, when the high-band component is reproduced by the SBR technique based on the envelope information and the tone information, two peaks adjacently exist in the decoded signal. Due to the adjacency of the two peaks, a beat occurs in terms of the auditory sense and the decoded audio signal significantly deteriorates.

The disclosed techniques aim at implementing coding processing that allows decoding of a tone signal with which a beat does not occur even if a peak whose frequency is adjacent with respect to the tone signal is acquired.

Figure 1:
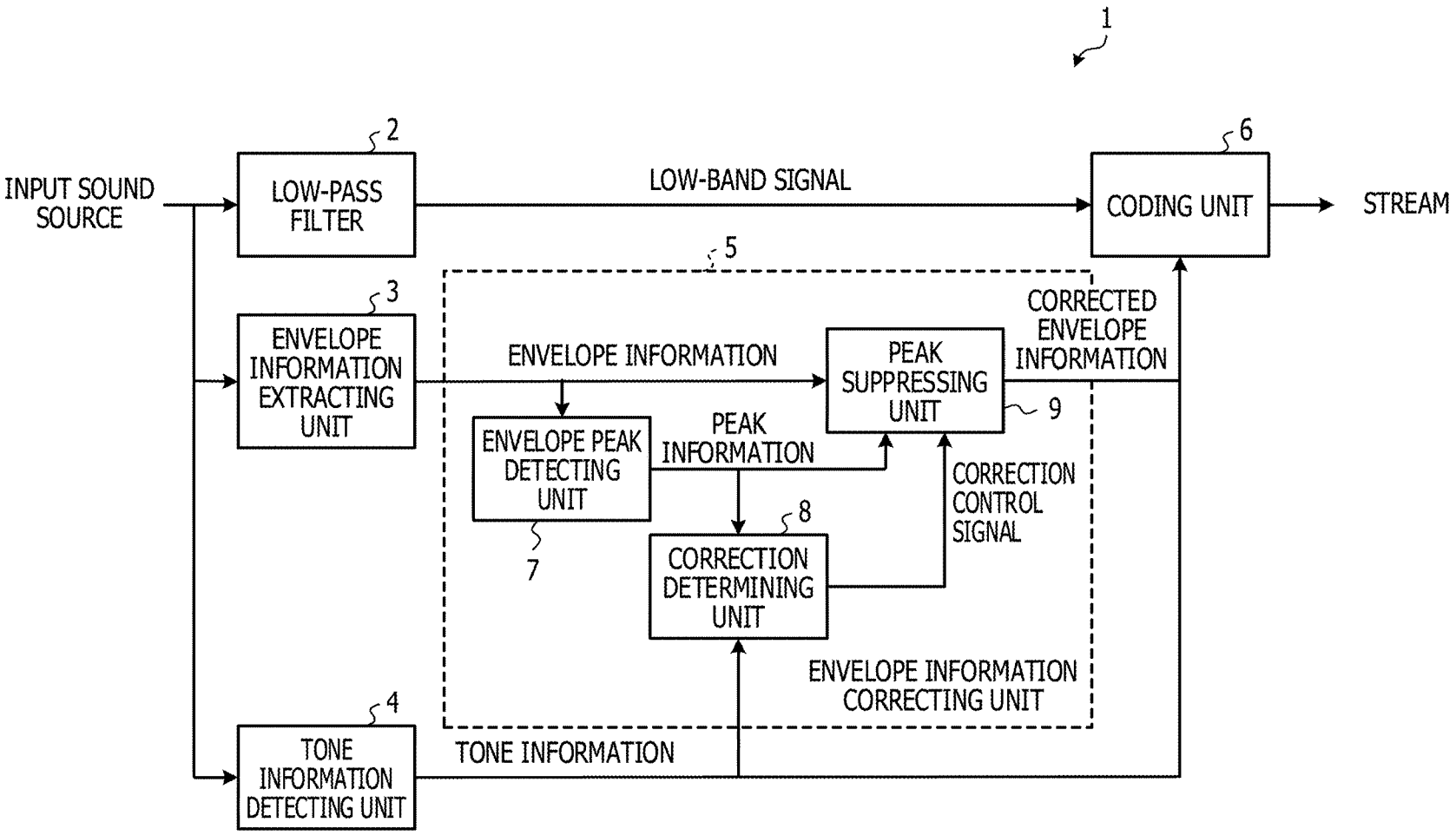
FIG. 1 is a functional block diagram illustrating one example of an audio coding device.

FIG. 1 is a functional block diagram illustrating one example of an audio coding device. In FIG. 1, an audio coding device 1 includes a low-pass filter 2, an envelope information extracting unit 3, a tone information detecting unit 4, an envelope information correcting unit 5, and a coding unit 6.

The envelope information correcting unit 5 carries out correction of envelope information based on the envelope information output from the envelope information extracting unit 3 and tone information output from the tone information detecting unit 4. The envelope information correcting unit 5 includes an envelope peak detecting unit 7, a correction determining unit 8, and a peak suppressing unit 9.

When detecting a peak equal to or larger than a threshold set in advance from the envelope information, the envelope peak detecting unit 7 outputs the frequency of the peak and the peak value as peak information. The correction determining unit 8 executes correction necessity-unnecessity determination processing of whether or not to correct the envelope information based on the peak information output from the envelope peak detecting unit 7 and the tone information output from the tone information detecting unit 4. If determining that the correction is necessary based on information relating to the peak information and a frequency and a peak value included in the tone information, the correction determining unit 8 outputs a correction control signal for instructing the peak suppressing unit 9 to correct the envelope information as the determination result. When receiving the correction control signal that instructs correction of the envelope information from the correction determining unit 8, the peak suppressing unit 9 corrects the envelope information received from the envelope information extracting unit 3 based on the peak information received from the envelope peak detecting unit 7 and outputs corrected envelope information to the coding unit 6.

The coding unit 6 executes coding and multiplexing processing of a low-band signal received from the low-pass filter 2, the corrected envelope information received from the envelope information correcting unit 5, and the tone information received from the tone information detecting unit 4 and outputs the processing result as a stream signal.

As described above, the audio coding device 1 may correct the envelope information based on the envelope information and the tone information.

Figure 2:
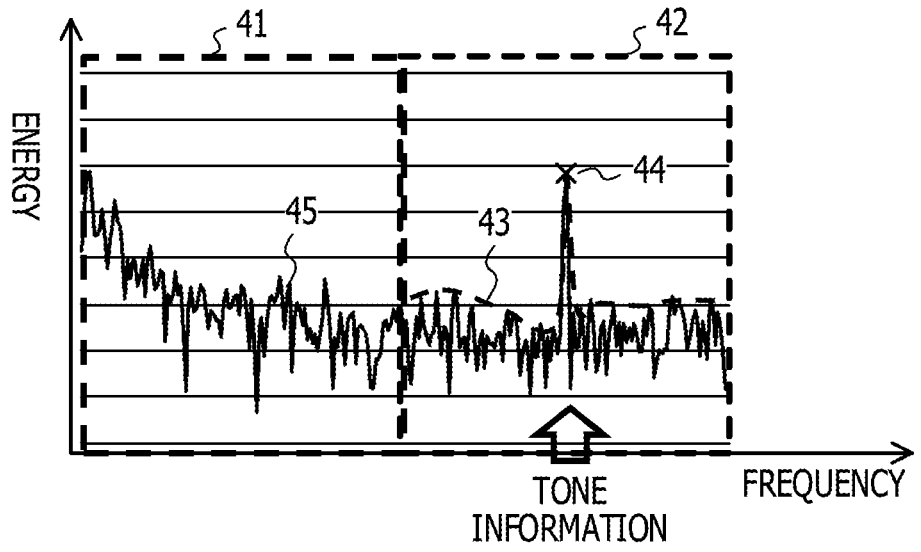
FIG. 2 is a spectrum diagram of an input sound source input to an audio coding device.

FIG. 2 is a spectrum diagram of an input sound source input to an audio coding device. In FIG. 2, the abscissa axis represents the frequency and the ordinate axis represents the magnitude of energy of the sound source at each frequency. A region 41 represents a low-band signal region. A region 42 represents a high-band signal region. For example, suppose that the frequency region of the low band is 0 to 5 kHz and the frequency region of the high band is 5 to 24 kHz.

A spectrum 45 is a frequency spectrum obtained by a frequency transform of the input sound source by a Fourier transform or the like. The low-pass filter 2 in the audio coding device 1 extracts the spectrum of the low band existing in the region 41 in the spectrum 45 corresponding to the input sound source. An envelope 43 is envelope information extracted by the envelope information extracting unit 3. The envelope information extracting unit 3 extracts the envelope information represented in the envelope 43 from the spectrum of the high band existing in the region 42 in the spectrum 45. A peak 44 is tone information extracted by the tone information detecting unit 4. The tone information detecting unit 4 detects the tone information represented in the peak 44 from the spectrum of the high band included in the region 42 in the spectrum 45.

As described above, the audio coding device 1 may enhance the compression ratio in coding by executing the SBR processing on the input sound source to extract the envelope information and the tone information regarding the high-band signal.

Figure 3:
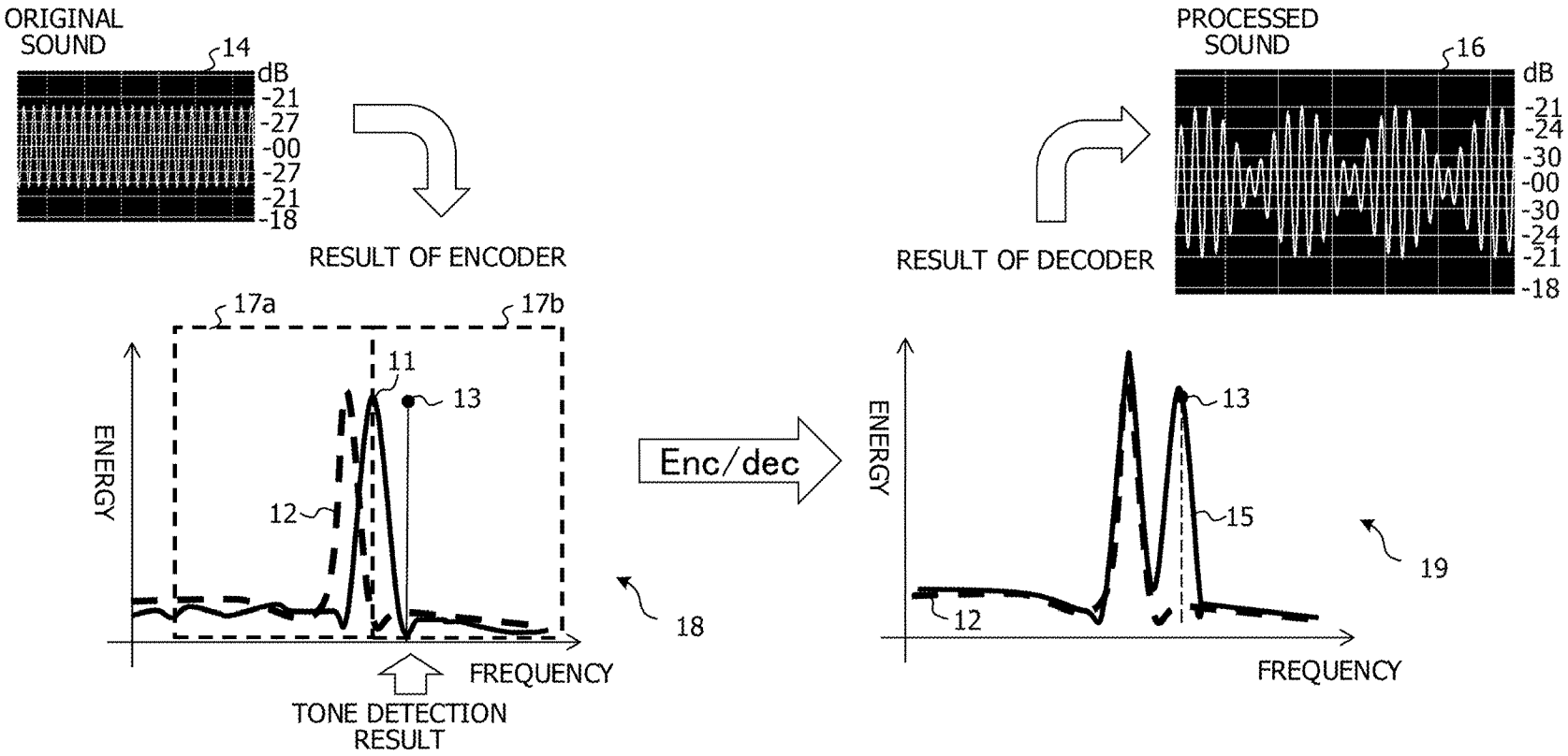
FIG. 3 is a diagram for explaining a problem that occurs in tone information detection.

FIG. 3 is a diagram for explaining a problem that occurs in tone information detection. In FIG. 3, a graph 14 represents the time waveform of an original sound of a tone signal input to the audio coding device 1. In the graph 14, the abscissa axis represents the time and the ordinate axis represents the energy. The tone signal is a signal having a single frequency and therefore is a sine wave having certain amplitude as illustrated in the graph 14.

A graph 18 represents processing of extracting the tone information from the tone signal as the original sound subjected to a frequency transform. In the graph 18, a spectrum 11 represents the spectrum of the original sound subjected to the frequency transform. Regions 17*a* and 17*b* represent sub-band regions. The sub-band regions are what are obtained by dividing the frequency region as the target of audio coding into plural frequency regions. If the peak of the spectrum 11 of the original sound is located at the boundary between the region 17*a* and the region 17*b* as in the graph 18, information on the peak of the spectrum 11 is included in both the region 17*a* and the region 17*b*. In the audio coding device 1, extraction processing of the envelope information and detection processing of the tone information are separately executed in each sub-band region. Therefore, for example, if the extraction processing of the envelope information and the detection processing of the tone information are executed at different resolutions, the tone information is acquired in a different sub-band region in some cases. In the graph 18, an envelope 12 is what is obtained by, in the region 17*a*, extracting the spectrum 11 of the original sound by the envelope information extracting unit 3. Furthermore, the tone information 13 is what is obtained by, in the region 17*b*, extracting information on the tone signal from the spectrum 11 of the original sound by the tone information detecting unit 4. Due to the extraction of information on the original sound as the envelope information and the tone information in two different sub-band regions, the information on the original sound becomes information in which two peaks adjacently exist through the coding although originally including one peak.

As represented by the graph 18, a graph 19 is the result of decoding of the tone signal 11 in the case in which, in audio coding, with respect to the original sound of the one tone signal 11, a peak is extracted as the envelope information as represented by the envelope 12 and a peak is detected as the tone information at a frequency different from the peak frequency of the envelope 12 as represented by the tone information 13. In decoding of the high-band signal subjected to the SBR processing, the low-band spectrum is copied into the high band and the energy level is adjusted based on the envelope information. If the frequency of a peak of the copied spectrum overlaps with the frequency of the peak of the envelope 12 as the result of the copying of the low-band spectrum, the peak extracted based on the envelope information is left as the high-band signal spectrum. When the tone signal spectrum is decoded based on the tone information 13 with respect to the high-band signal spectrum decoded based on the envelope information, a spectrum in which two peaks are adjacent is decoded as represented by a spectrum 15.

A graph 16 is a time waveform corresponding to the spectrum 15. When the spectrum in which the two peaks are adjacent is transformed to the time waveform by an inverse Fourier transform or the like, signals of the two adjacent frequencies interfere with each other and a beat occurs as represented by the graph 16. Because such a beat does not occur in the original sound, the occurrence of the beat becomes a cause of the lowering of the quality of the decoded sound.

In FIG. 3, the case in which the peak frequency in the envelope information and the peak frequency in the tone information are adjacent is described by taking as an example the case in which the tone signal as the original sound exists at the boundary between the sub-band regions. However, this example does not intend to identify the cause of occurrence of the peak frequencies in the two different pieces of information.

Figure 4:
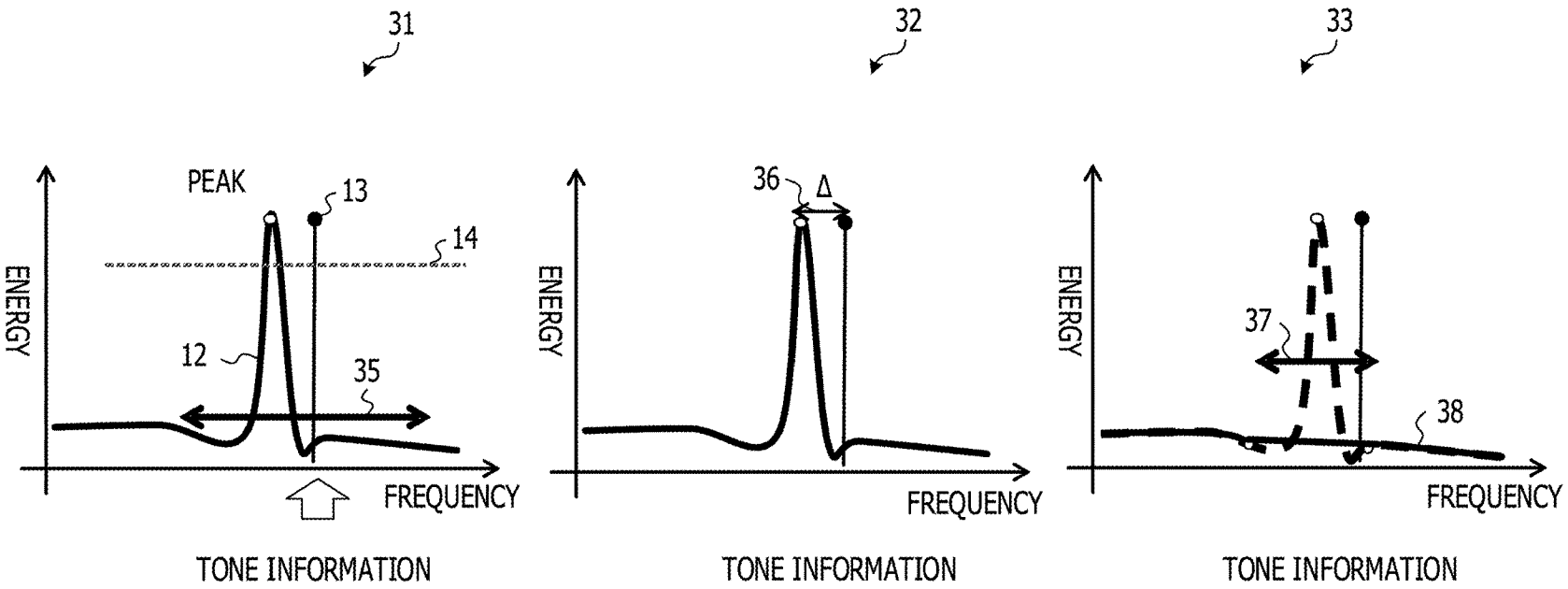
FIG. 4 is a diagram for explaining envelope information correction processing.

FIG. 4 is a diagram for explaining envelope information correction processing. In FIG. 4, a graph 31 represents the state in which a peak frequency in the envelope information and a peak frequency in the tone information are adjacent. When detecting a peak equal to or larger than a threshold 21 in the envelope information, the envelope information correcting unit 5 in FIG. 1 checks whether or not this peak exists within a detection range 35 with respect to the peak frequency of the tone information. If a peak that satisfies this condition is detected regarding the envelope information, the envelope information correcting unit 5 deems this peak as the correction target of the envelope information. A concrete example of the detection range 35 will be described later.

A graph 32 represents that it is desirable that the peak frequency in the envelope information is separate from the peak frequency in the tone information by Δ or larger. Δ is a value close to zero but a beat does not occur if Δ is zero. Thus, the condition represented in the graph 32 intends to exclude the case in which a beat does not occur.

A graph 33 represents correction of the envelope information in the case in which a peak of the envelope information satisfying the conditions represented in the graph 31 and the graph 32 is detected. In the graph 33, a dotted line represents the envelope information before the correction and a solid line 38 represents the envelope information after the correction. The envelope information correcting unit 5 carries out correction regarding the detected envelope information based on a certain range 37 defined in advance as represented by the solid line 38. As the result of the correction, the peak energy of the envelope information becomes sufficiently lower than the peak energy of the tone information. Thus, the occurrence of a beat may be suppressed.

In FIG. 4, the case in which the peak value of the envelope information is suppressed is described. However, the occurrence of a beat may be suppressed also by suppressing the peak value of the tone information instead of the envelope information. Furthermore, the tone information of the SBR is based on a system in which ON/OFF is specified regarding each sub-band in a standard such as moving picture experts group (MPEG). Thus, the tone information may be set OFF. In the case of this system, the frequency of the peak possessed by the tone information is a given frequency associated in advance regarding each sub-band.

Figure 5:
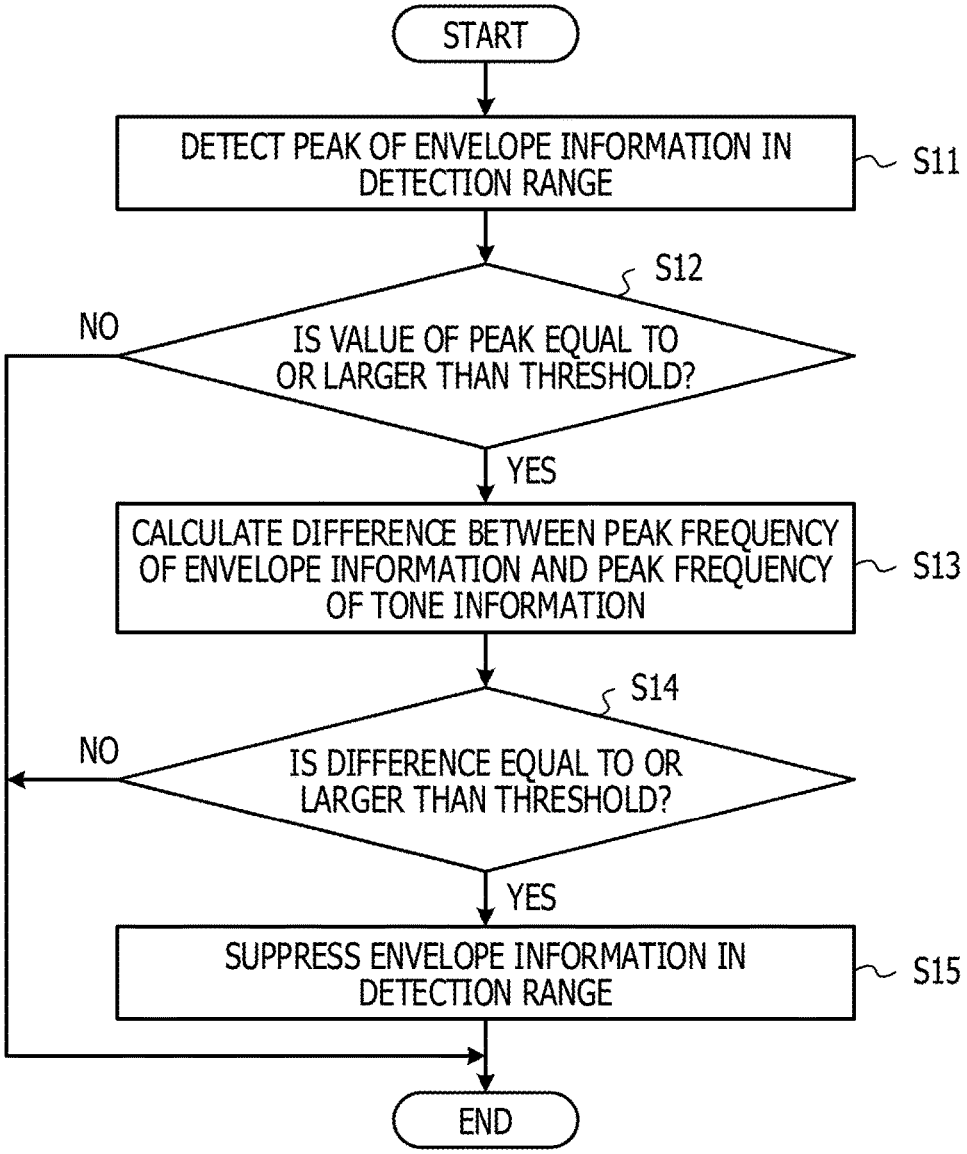
FIG. 5 is a diagram illustrating an envelope information correction processing flow.

FIG. 5 is a diagram illustrating an envelope information correction processing flow. The envelope information correction processing flow is carried out by the envelope information correcting unit 5, for example. The envelope information correction processing flow may be implemented by executing an envelope information correction program stored in a memory by a processor in a general-purpose computer including the memory and the processor.

The envelope information correcting unit 5 detects a peak of envelope information in the detection range based on tone information (step S11). If the value of the detected peak is equal to or larger than a threshold set in advance (step S12: YES), the envelope information correcting unit 5 calculates the difference between the peak frequency of the detected envelope information and the peak frequency of the tone information (step S13). If the value of the detected peak is smaller than the threshold (step S12: NO), the envelope information correcting unit 5 ends the envelope information correction processing.

If the difference value calculated in the step S13 is equal to or larger than a threshold set in advance (step S14: YES), the envelope information correcting unit 5 suppresses the peak of the envelope information in the detection range and corrects the value of the peak to a level with which a beat does not occur (step S15). If the difference value is smaller than the threshold (step S14: NO), the envelope information correcting unit 5 ends the envelope information correction processing.

As described above, the envelope information correcting unit 5 may suppress the occurrence of a beat by correcting the envelope information based on the envelope information correction processing flow.

(Expression 1) is an expression that represents the relationship between a sub-band number i and a sub-band width SBW. In (expression 1), INT denotes a function for rounding down a value to zero decimal places. "pow" denotes an exponential function. F denotes the frequency resolution. "start" denotes a high-band generation start frequency index. "stop" denotes a high-band generation end frequency index. "numbands" denotes the number of sub-bands. The frequency index is what is obtained by giving a number from the lower band sequentially regarding frequency bands arising from dividing at a frequency resolution corresponding to F. For example, if a signal of 48-kHz sampling is subjected to a frequency transform by an orthogonal transform such as a modified discrete cosine transform in units of analysis length of 1024 samples, a frequency spectrum that may be expressed by 512 samples whose upper limit is 24 kHz is obtained. If this frequency spectrum is expressed as spec[j] (j=0 to 512), j is the frequency index.

$$SBW = F * \left( INT\left(\text{start} * \text{pow}\left(\frac{\text{stop}}{\text{start}}, \frac{i+1}{num_{bands}}\right) + 0.5\right) - INT\left(\text{start} * \text{pow}\left(\frac{\text{stop}}{\text{start}}, \frac{i}{num_{bands}}\right) + 0.5\right)\right) \quad \text{(Expression 1)}$$

$$0 \le i < numbands - 1$$

Figure 6:
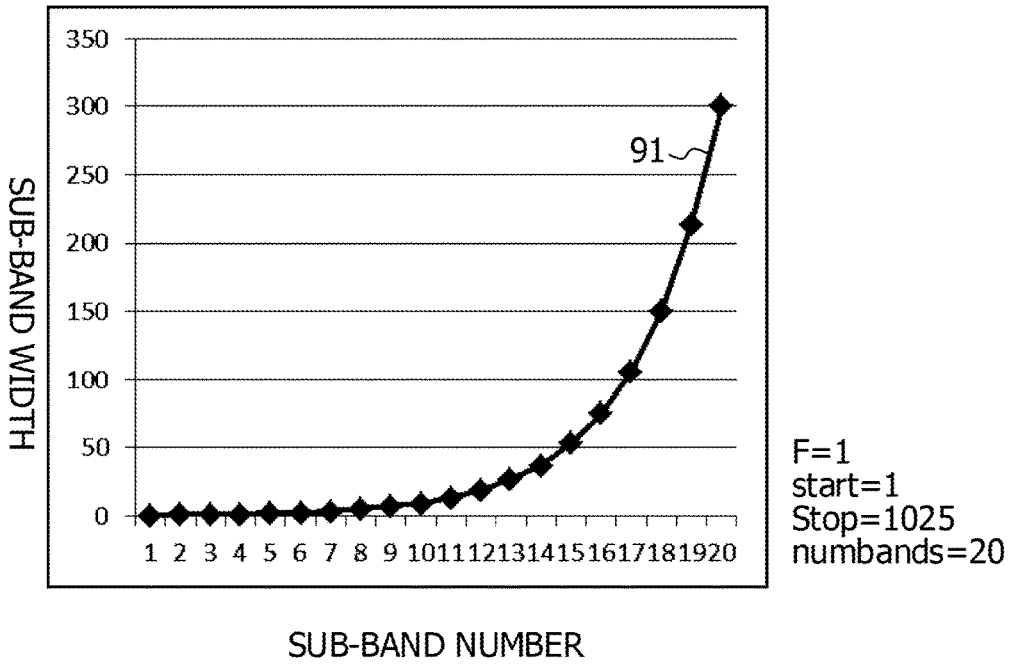
FIG. 6 is a graph that represents change in a sub-band width SBW with respect to a sub-band number i.

FIG. 6 is a graph that represents change in a sub-band width SBW with respect to a sub-band number i. A graph 91 represents the relationship between the sub-band number i and the sub-band width SBW in the case in which F=1, start=1, stop=1025, numbands=20 are set in (Expression 1).

The sub-band number i is what is obtained by giving a number from the lower frequency band sequentially when the frequency band as the target of audio coding processing is divided into plural bands. The sub-band width SBW is the bandwidth of the sub-band given each sub-band number i. As represented in the graph 91 in FIG. 6, the sub-band width SBW becomes larger when the sub-band number i becomes larger, for example, when the frequency becomes higher. By causing regions whose sub-band width SBW is small to correspond to the human audible band, the number of sub-bands included in the audible band may be set large. The processing of the audio signal is executed in units of sub-band. Thus, if the number of samples set regarding each sub-band is the same, the resolution of the audible band may be set high and the resolution of bands whose importance is low may be set low by setting the number of sub-bands large.

Figure 7:
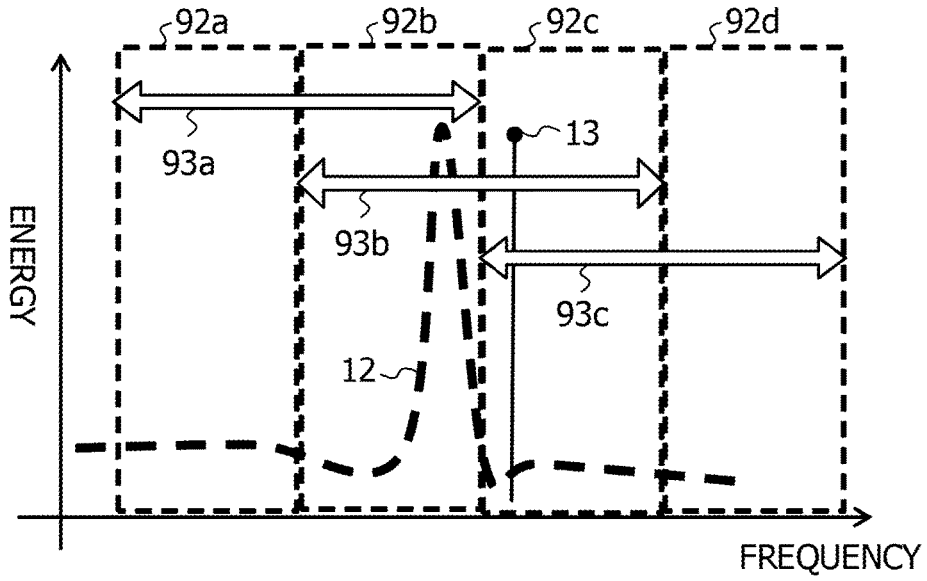
FIG. 7 is a diagram illustrating a concrete example of a detection range in peak detection of envelope information.

FIG. 7 is a diagram illustrating a concrete example of a detection range in peak detection of envelope information. In FIG. 7, sub-bands 92*a* to 92*d* represent the respective sub-bands and ranges 93*a* to 93*c* represent the detection ranges in peak detection processing.

In the embodiment of FIG. 7, a detection range W for detecting a peak of the envelope information has a value obtained by summing the sub-band widths SBW of two consecutive sub-bands. The envelope information correcting unit 5 changes the band of the detection range W while incrementing the sub-band number i one by one. As described with FIG. 3, if a tone signal of the original sound exists at the boundary between sub-band regions, the peak of the envelope information and the peak of the tone information are included in sub-band regions different from each other. It is desirable that the detection range W is set to the bandwidth of two sub-band regions in order to allow detection of the respective peaks even in this case. The detection range W is not limited to two sub-band regions.

(Expression 2) is an expression that defines the detection range W of peak detection based on (Expression 1).

$$W = F * \left( INT\left(\text{start} * \text{pow}\left(\frac{\text{stop}}{\text{start}}, \frac{i+2}{num_{bands}}\right) + 0.5\right) - INT\left(\text{start} * \text{pow}\left(\frac{\text{stop}}{\text{start}}, \frac{i}{num_{bands}}\right) + 0.5\right)\right) \quad 0 \le i < numbands - 1 \qquad \text{(Expression 2)}$$

When (Expression 1) and (Expression 2) are compared, the integer value added to the sub-band number i is changed from 1 to 2. The envelope information correcting unit 5 may carry out the peak detection of the envelope information by adjusting the integer value added to the sub-band number i based on (Expression 2) to define the detection range W.

Figure 8:
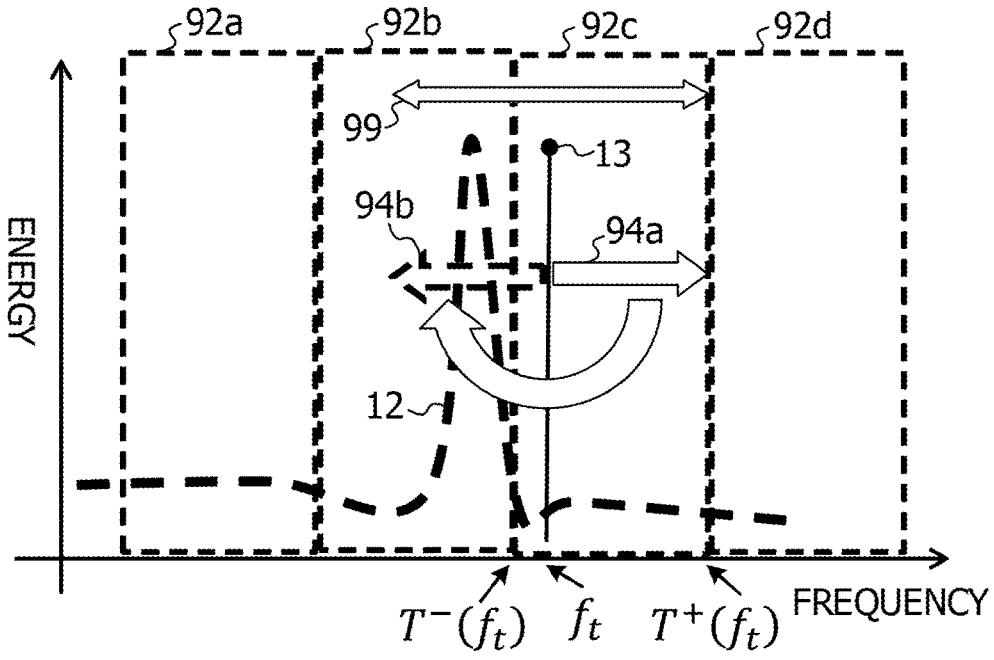
FIG. 8 is a diagram illustrating another concrete example of a detection range in peak detection of envelope information.

FIG. 8 is a diagram illustrating another concrete example of a detection range in peak detection of envelope information. In FIG. 8, the same element as FIG. 7 is given the same symbol. In the case in which the tone information 13 exists in the sub-band region 92*c* as represented in FIG. 8, the tone frequency corresponding to the tone information 13 is defined as ft and the minimum value and maximum value of the band of the sub-band region 92*c* are defined as $T^-(ft)$ and $T^+(ft)$, respectively. When the difference value whose absolute value is larger in the difference between the tone frequency ft and $T^-(ft)$ and the difference between the tone frequency ft and $T^+(ft)$ is defined as d(ft), $d(ft)=\max(|T^-(ft)-ft|, |T^+(ft)-ft|)$ is obtained. In FIG. 8, a range 94*a* is equivalent to the difference d(ft). If the difference between the tone frequency ft and $T^+(ft)$ is larger as represented in FIG. 8, the envelope information correcting unit 5 extends the range d(ft) also to the lower frequency side based on the tone frequency ft as the detection range W. For example, the envelope information correcting unit 5 sets the detection range W to W=[ft−d(ft), ft+d(ft)]. In FIG. 8, a range 99 is equivalent to the detection range W and is the range obtained by adding the range 94*a* and a range 94*b*.

As described above, the envelope information correcting unit 5 may detect the peak of the envelope information 12 having a relation to the tone information 13 more efficiently by setting the detection range W centered at the tone frequency.

Figure 9:
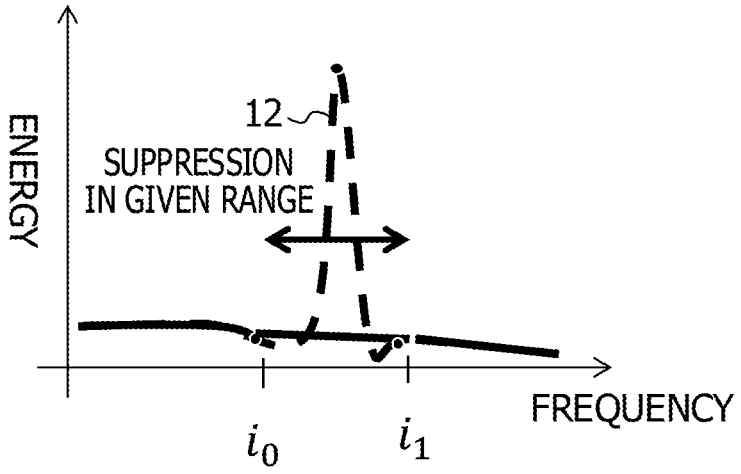
FIG. 9 is a diagram for explaining correction of a peak of envelope information.

FIG. 9 is a diagram for explaining correction of a peak of envelope information. In FIG. 9, if a peak of the envelope information 12 is a cause of the occurrence of a beat, the peak value of the sub-band section in which the peak of the envelope information 12 exists is suppressed. When the sub-band number of the sub-band region in which the peak of the envelope information 12 is detected is defined as b, a minimum value i0 and a maximum value i1 of the peak suppression section in FIG. 9 are each as represented by (Expression 3).

$$i_0 = INT\left(\text{start} * \text{pow}\left(\frac{\text{stop}}{\text{start}}, \frac{b}{num_{bands}}\right) + 0.5\right) \qquad \text{(Expression 3)}$$

$$i_1 = INT\left(\text{start} * \text{pow}\left(\frac{\text{stop}}{\text{start}}, \frac{b+1}{num_{bands}}\right) + 0.5\right)$$

The envelope information correcting unit 5 calculates i0 and i1 based on the sub-band number b of the sub-band region in which the peak of the envelope information 12 has been detected and (Expression 3) and carries out correction to an envelope that couples the value corresponding to i0 and the value corresponding to i1 by a straight line in the envelope information 12. By suppressing the peak of the envelope information that causes a beat by such correction, the audio coding device 1 may code the input signal in such a manner that the quality of the audio signal after decoding is improved.

Figure 10:
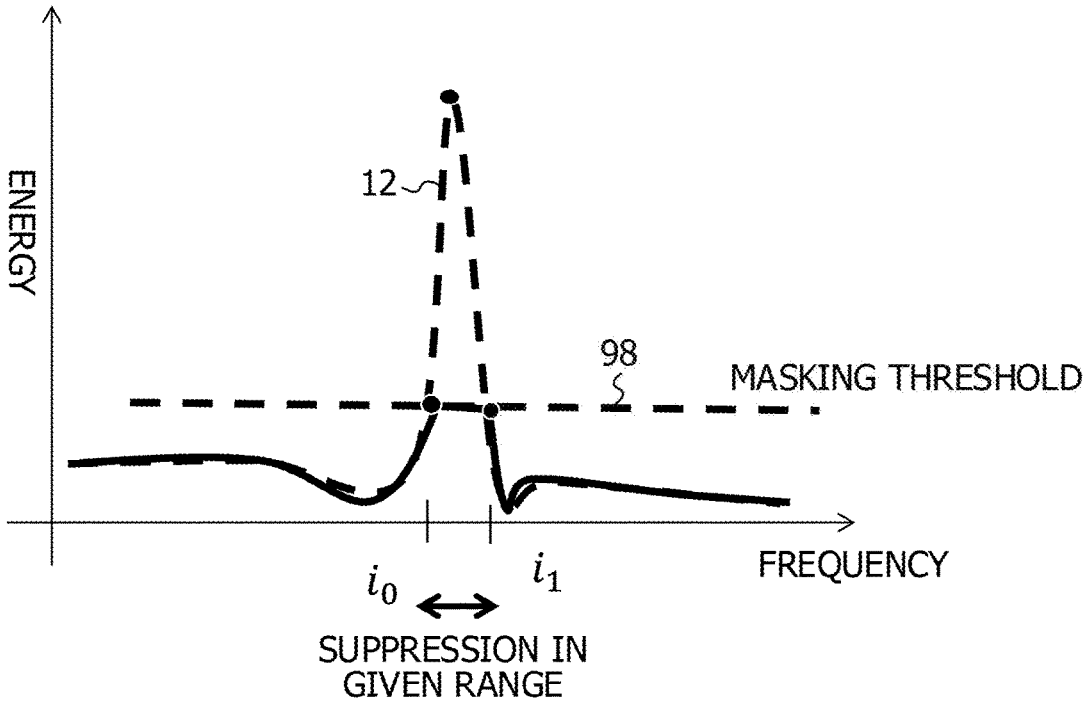
FIG. 10 is a diagram for explaining another correction of a peak of envelope information.

FIG. 10 is a diagram for explaining another correction of a peak of envelope information. In FIG. 10, a masking threshold 98 is a threshold set based on the human auditory limit with respect to the sound volume, obtained based on an equal-loudness contour or the like. The equal-loudness contour is what is obtained by measuring the sound pressure level at which the loudness of a sound based on the human auditory sense becomes substantially equal when the frequency of the sound is changed and linking the measured sound pressure level as a contour. The equal-loudness contour is internationally standardized as International Organization for Standardization (ISO) 226:2003.

As the masking threshold, the minimum value of the equal-loudness contour corresponding to the frequency band of a signal as the audio coding target may be set. Alternatively, the sound pressure level represented by the equal-loudness contour may be set based on the frequency of the peak as the correction target in the envelope information.

By correcting the envelope information based on the magnitude relationship with the masking threshold, a beat at the time of decoding may be suppressed with a smaller amount of calculation.

Figure 11:
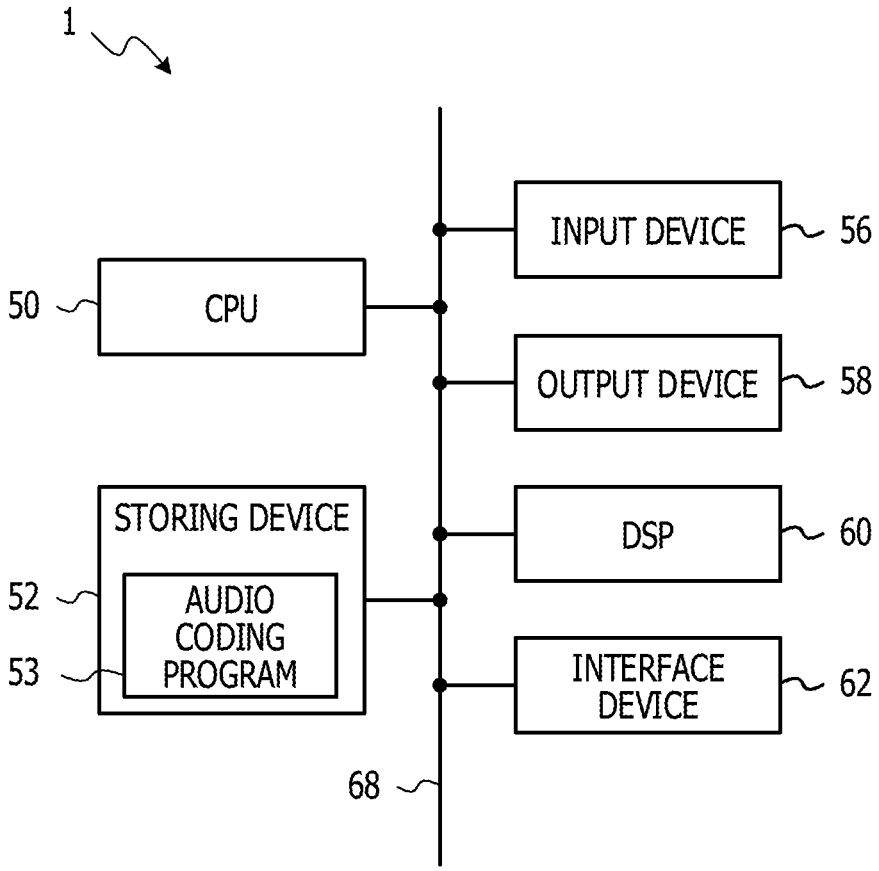
FIG. 11 is a hardware block diagram of an audio coding device.

FIG. 11 is a hardware block diagram of an audio coding device. The audio coding device 1 includes a central processing unit (CPU) 50, a storing device 52, an input device 56, an output device 58, a DSP 60, and an interface device 62. The respective devices are coupled to each other by a bus 68.

The CPU 50 functionally implements the respective functional blocks illustrated in FIG. 1 by executing an audio coding program 53 stored in the storing device 52. The storing device 52 is a device for storing programs and data and includes a hard disk drive (HDD), a solid state drive (SSD), a read only memory (ROM), a random access memory (RAM), and so forth.

The input device 56 is a device for inputting information for processing of the audio coding device 1 from the external. The input device 56 includes a microphone, a keyboard, a mouse, and so forth. The output device 58 is a device for outputting the processing result of the audio coding device 1 to the external. The output device 58 includes a speaker, a display, and so forth. The DSP 60 is an abbreviation for a digital signal processor and executes, at high speed, processing of a frequency transform and so forth of an audio signal converted to a digital signal. The interface device 62 is a coupling part for implementing coupling of the audio coding device 1 to a network and coupling to an external storing device.

As described above, the audio coding device 1 may be implemented by executing the audio coding program by using a general-purpose computer.

Figure 12:
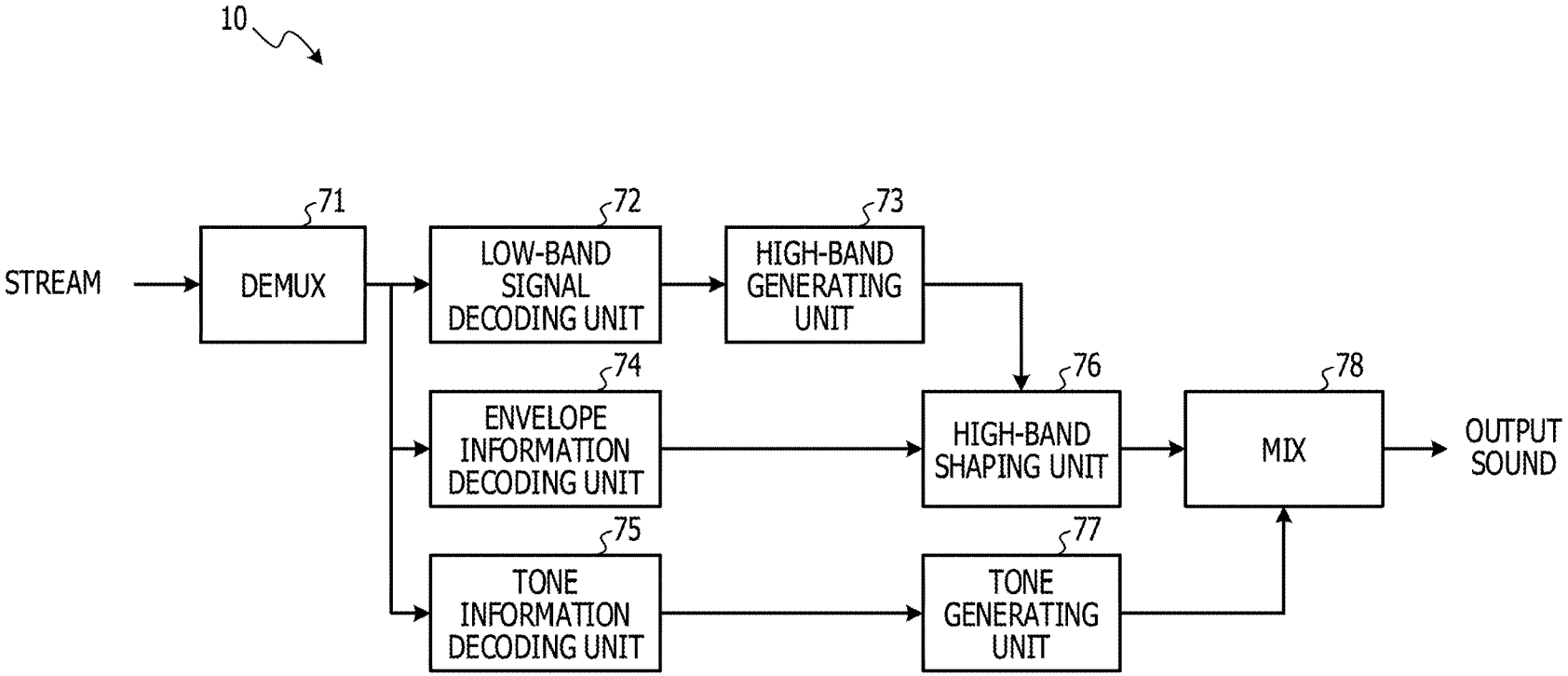
FIG. 12 is a functional block diagram of an audio decoding device.

FIG. 12 is a functional block diagram of an audio decoding device. An audio decoding device 10 decodes a stream signal coded by the audio coding device 1 and outputs an audio signal. The audio decoding device 10 includes a DEMUX 71, a low-band signal decoding unit 72, a high-band generating unit 73, an envelope information decoding unit 74, a tone information decoding unit 75, a high-band shaping unit 76, a tone generating unit 77, and a MIX 78.

The DEMUX 71 means a demultiplexer and demultiplexes a multiplexed stream signal into plural signals. The low-band signal decoding unit 72 decodes a coded low-band signal spectrum in the demultiplexed signals. The high-band generating unit 73 generates a high-band signal spectrum by copying the decoded low-band signal spectrum into the high band. The envelope information decoding unit 74 decodes coded envelope information in the demultiplexed signals. The tone information decoding unit 75 decodes coded tone information in the demultiplexed signals. The high-band shaping unit 76 corrects a peak of the high-band signal spectrum generated by the high-band generating unit 73 based on the envelope information output from the envelope information decoding unit 74. The tone generating unit 77 generates a tone signal based on the decoded tone information. The MIX 78 combines the high-band signal spectrum after the correction output from the high-band shaping unit 76 and the tone signal output from the tone generating unit 77 and outputs the decoded signal spectrum resulting from the combining.

As described above, the audio decoding device 10 may output the decoded signal based on the signal coded by the present embodiment.

Figure 13:
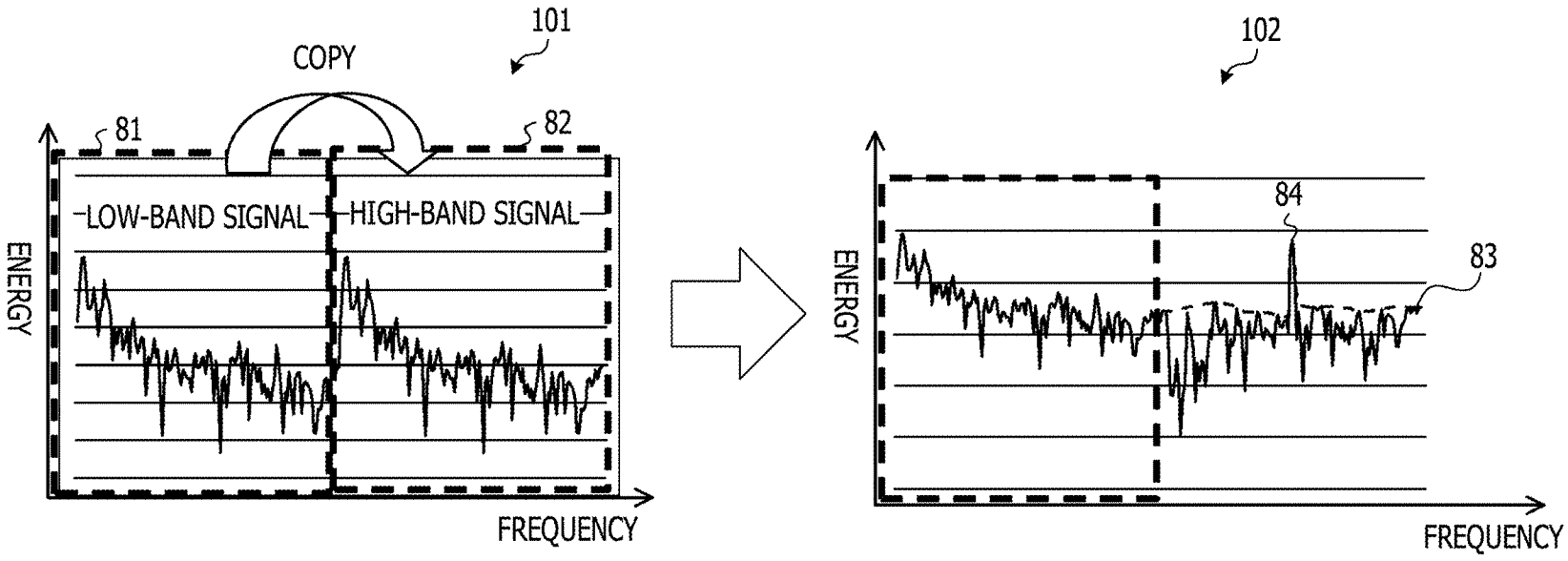
FIG. 13 is a diagram for explaining decoding processing by an audio decoding device.

FIG. 13 is a diagram for explaining decoding processing by an audio decoding device. In a graph 101 in FIG. 13, a region 81 represents the low-band signal region and a region 82 represents the high-band signal region. The high-band generating unit 73 copies the low-band signal spectrum of the region 81 into the region 82 to generate a high-band signal spectrum.

In a graph 102, an envelope 83 represents an envelope of the high-band signal spectrum based on the envelope information and a peak 84 represents the peak of a tone signal based on the tone information. The high-band shaping unit 76 carries out correction of the energy level based on the envelope 83 for the high-band signal spectrum arising from the copying. The MIX 78 combines the peak 84 with the high-band signal spectrum corrected based on the envelope 83.

As described above, the audio decoding device 10 may decode an audio signal based on the low-band signal spectrum, the envelope information, and the tone information that are decoded.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An audio coding device comprising:

a filter configured to extract a low-band signal having a first frequency component from an input signal;

a memory; and a processor coupled to the memory and configured to:

extract envelope information relating to an envelope of a high-band signal having a second frequency component which is higher than the first frequency component in the input signal, detect tone information that is information on a tone signal included in a high-band signal spectrum from the input signal, correct the envelope information based on a difference between frequency of the tone signal and frequency of a peak of the envelope, and code the low-band signal, the tone information, and the envelope information that is corrected.

2. The audio coding device according to claim 1, wherein the processor further detects an envelope peak that is a peak included in the envelope information, determines whether or not to correct the envelope information based on the envelope peak and the tone information, and suppresses the peak included in the envelope information based on a result of the determination.

3. The audio coding device according to claim 1, wherein the processor further determines that correction is necessary if a peak value of the envelope peak is equal to or larger than a given value and a difference value between frequency at the peak value of the envelope peak and frequency at a peak value of the tone information is equal to or larger than a given value.

4. The audio coding device according to claim 2, wherein if the processor executes coding processing after dividing the high-band signal spectrum into a plurality of sub-bands, the processor detects the envelope peak while employing adjacent two of the sub-bands as a detection range.

5. The audio coding device according to claim 3, wherein the processor corrects the peak value of the envelope peak or the peak value of the tone information based on a masking threshold if determining that correction is necessary.

6. An audio coding method comprising:

extracting, by a processor, a low-band signal having a first frequency component from an input signal;

extracting, by a processor, envelope information relating to an envelope of a high-band signal having a second frequency component which is higher than the first frequency component in the input signal;

detecting, by a processor, tone information that is information on a tone signal included in a high-band signal spectrum from the input signal;

correcting, by a processor, the envelope information based on a difference between frequency of the tone signal and frequency of a peak of the envelope; and coding, by a processor, the low-band signal, the tone information, and the envelope information that is corrected.

* * * * *